US006497225B1

(12) United States Patent
Bircann et al.

(10) Patent No.: US 6,497,225 B1
(45) Date of Patent: Dec. 24, 2002

(54) EGR METERING SUBASSEMBLY INCLUDING A GAS ARRESTOR

(75) Inventors: Raul A. Bircann, Penfield, NY (US); Dwight O. Palmer, Rochester, NY (US)

(73) Assignee: Delphi Technologies, Inc., Troy, MI (US)

( * ) Notice: Subject to any disclaimer, the term of this patent is extended or adjusted under 35 U.S.C. 154(b) by 0 days.

(21) Appl. No.: 09/721,223

(22) Filed: Nov. 22, 2000

Related U.S. Application Data

(60) Provisional application No. 60/184,630, filed on Feb. 24, 2000.

(51) Int. Cl.[7] ..... F02M 25/07

(52) U.S. Cl. ..... 123/568.11; 123/568.21; 251/129.15

(58) Field of Search ..... 123/568.11, 568.21, 123/568.26, 568.27, 568.29, 568.24; 251/129.15, 333, 334, 129.11; 137/907

(56) References Cited

U.S. PATENT DOCUMENTS

| | | | | | |
|---|---|---|---|---|---|
| 3,858,842 A | | 1/1975 | Yoshmura | ..... | 251/61.2 |
| 4,285,317 A | | 8/1981 | Takahara et al. | ..... | 123/568.29 |
| 4,351,285 A | | 9/1982 | Bradshaw | ..... | 123/568.29 |
| 4,531,498 A | * | 7/1985 | Bradshaw | ..... | 123/568.29 |
| 5,718,259 A | | 2/1998 | Miyake et al. | ..... | 137/338 |
| 5,749,350 A | * | 5/1998 | Bender | ..... | 123/568.24 |
| 6,295,975 B1 | * | 10/2001 | Yew et al. | ..... | 251/333 |

FOREIGN PATENT DOCUMENTS

| | | | | |
|---|---|---|---|---|
| EP | 0461688 | | 12/1991 | |
| EP | 0962646 | | 12/1999 | |
| JP | 1-203646 A | * | 8/1989 | ..... 123/568.24 |
| WO | 99/47842 | | 9/1999 | |

* cited by examiner

*Primary Examiner*—Willis R. Wolfe
(74) *Attorney, Agent, or Firm*—Patrick M. Griffin

(57) ABSTRACT

A metering subassembly for use with a modular EGR valve includes a metering subassembly having an elongate metering shaft. A flanged end of the metering shaft is disposed a predetermined distance above a top surface of the metering subassembly. The metering subassembly is configured for being coupled to an actuator subassembly such that the flanged end of the metering shaft is disposed proximate the actuator subassembly. A gas arrestor includes a side wall interconnected with a collar. The collar surrounds a periphery of the flanged end. The side wall extends from the collar in a direction generally toward the top surface of the metering subassembly.

17 Claims, 2 Drawing Sheets

EGR METERING SUBASSEMBLY INCLUDING A GAS ARRESTOR

CROSS-REFERENCE TO RELATED APPLICATIONS

This application claims the benefit of U.S. Provisional Patent Application Ser. No. 60/184,630, filed Feb. 24, 2000.

TECHNICAL FIELD

The present invention relates to exhaust gas recirculation valves and, more particularly, to a modular metering subassembly having a gas arrestor.

BACKGROUND OF THE INVENTION

Exhaust gas recirculation (EGR) valves capture engine exhaust and recycle at least a portion of that captured exhaust gas into the combustion chamber of the engine to improve combustion. Exhaust gas is used since it is readily available and contains only a small amount of oxygen. Adding the exhaust gas to the air in the combustion chamber has the effect of lowering the combustion temperature below the point at which nitrogen combines with oxygen. Thus, exhaust gas recirculation increases fuel economy and reduces the level of undesirable emissions.

Conventional EGR valves include an actuator and a metering base. The metering base includes a metering chamber having a metering port. The metering chamber has an end that is associated with the intake manifold or intake vacuum of the engine. The metering port is connected to a source of exhaust gas and provides a passageway for the flow of exhaust gas into the metering chamber. An elongate shaft extends contiguously in a longitudinal direction from the actuator, through an orifice in the metering base, into the metering chamber, and to the metering port. A metering poppet, which is a plunger-shaped member, is disposed at the end of the shaft proximate to the metering port. In a default position, the metering poppet abuttingly engages or is disposed within the metering port, thereby sealing the metering port. In this default position, no exhaust gas enters the metering chamber through the metering port. The shaft is reciprocated to displace the metering poppet from engagement with the metering port thereby unsealing the metering port and allowing exhaust gas to flow through the metering port into the metering chamber and into the intake manifold of the engine. Thus, the reciprocal motion of the shaft and metering poppet selectively control the flow of exhaust gas into the intake air stream of the engine.

The contiguous shaft extends from within the actuator and terminates proximate the metering port. In order for the EGR valve to operate properly, the shaft must pass in a substantially concentric manner through the actuator orifice, through the orifice in the metering assembly, and into the metering port. Typically, due to manufacturing tolerances and process variation, these orifices are not perfectly concentric. As the shaft is reciprocated within these non-concentric orifices, the shaft may rub or perhaps even bind against one of the orifices. Furthermore, the metering poppet may rub or otherwise interfere with the metering port. Thus, increased frictional forces may be encountered during reciprocation of the shaft. Similarly, if the shaft as installed is not substantially perpendicular to the orifices, increased frictional forces may also be encountered during reciprocation of the shaft. In order to reciprocate the shaft these frictional forces must be overcome. Therefore, the actuator must provide a substantially larger force in order to overcome the increased friction and reciprocate the shaft. An actuator which is capable of overcoming the frictional forces typically must be larger in size and greater in weight than would be necessary if those frictional forces were minimized or eliminated.

Space is at a premium within the cramped engine compartments of the technologically-advanced vehicles of today. Furthermore, automobile manufactures are continuously striving to reduce the weight of vehicles to thereby improve fuel economy. These design considerations dictate that EGR valves, and the components thereof, be as compact and as light as possible. Therefore, it is desirable to make actuators as small and as light as is practicable. However, the actuator must be capable of producing enough power to overcome the frictional forces. The presence of these frictional forces place a limit upon the reductions in actuator size and weight which are obtainable in practice.

Conventional EGR valves do not sufficiently seal the actuator from the metering chamber and the exhaust gases carried thereby. More particularly, conventional EGR valves typically employ a journal bearing disposed around the actuator shaft. Some clearance must exist between the journal bearing and the shaft in order for the shaft to be freely reciprocated by the actuator. Thus, the journal bearing does not completely seal exhaust gases from penetrating into the actuator through the clearance between the journal bearing and the shaft. This makes possible the convection of exhaust gases into the actuator. Furthermore, fluctuating pressures and high back pressure in the exhaust and intake manifolds tend to force the exhaust gas through the clearance between the journal bearing and the shaft, and into the actuator. Exhaust gas typically has a high moisture content and is also highly corrosive. The intrusion of exhaust gas into the actuator can result in malfunction or even premature failure of the actuator.

Therefore, what is needed in the art is an EGR valve which reduces the need for concentricity of the shaft relative to the actuator orifice, the metering orifice, and the metering port.

Furthermore, what is needed in the art is an EGR valve which has a reduced sensitivity to manufacturing tolerances and process variations in the shaft, and in the alignment of the shaft relative to the actuator orifice, the metering orifice, and the metering port.

Moreover, what is needed in the art is an EGR valve which reduces the intrusion of exhaust gas into the actuator.

SUMMARY OF THE INVENTION

The present invention provides a metering subassembly having a gas arrester for use in a modular EGR valve.

The present invention comprises, in one form thereof, a metering subassembly having an elongate metering shaft. A flanged end of the metering shaft is disposed a predetermined distance above a top surface of the metering subassembly. The metering subassembly is configured for being coupled to an actuator subassembly such that the flanged end of the metering shaft is disposed proximate the actuator subassembly. A gas arrestor includes a side wall interconnected with a collar. The collar surrounds a periphery of the flanged end. The side wall extends from the collar in a direction generally toward the top surface of the metering subassembly.

An advantage of the present invention is that the adverse effects of a shaft being non-concentric relative to the actuator orifice is reduced.

Another advantage of the present invention is that sensitivity to manufacturing tolerances and process variation in the alignment of the actuator and the metering base to is reduced.

An even further advantage of the present invention is that it reduces the penetration of exhaust gas into the actuator.

BRIEF DESCRIPTION OF THE DRAWINGS

The above-mentioned and other features and advantages of this invention, and the manner of attaining them, will become more apparent and the invention will be better understood by reference to the following description of an embodiment of the invention taken in conjunction with the accompanying drawings, wherein.

Corresponding reference characters indicate corresponding parts throughout the several views. The exemplification set out herein illustrates one preferred embodiment of the invention, in one form, and such exemplification is not to be construed as limiting the scope of the invention in any manner.

DETAILED DESCRIPTION OF THE INVENTION

Figure 1:
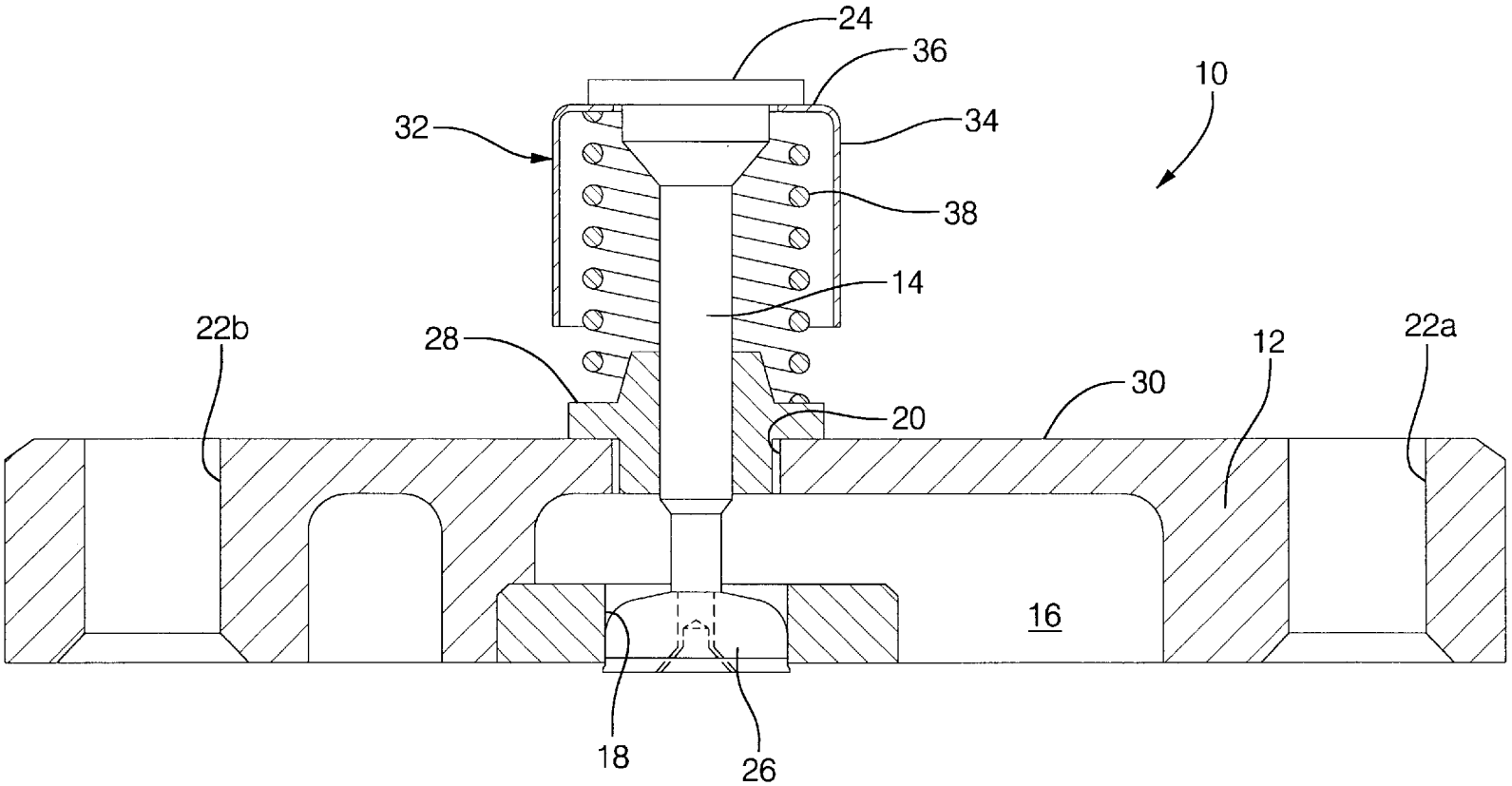
FIG. 1 is a partially sectioned view of one embodiment of the metering subassembly of the present invention.

With reference to the Figures, and particularly to FIG. 1, there is shown one embodiment of the metering subassembly including a gas arrestor of the present invention. Metering subassembly 10 includes metering base 12 and metering shaft 14.

Metering base 12 defines metering chamber 16, metering port 18 and shaft orifice 20. As will be described more particularly hereinafter, metering port 18 and metering chamber 16 selectively provide a passageway for the flow of exhaust gas into a combustion chamber of an engine. Shaft orifice 20 is concentrically disposed above metering port 18. Metering base 12 further defines mounting bores 22*a* and 22*b* therethrough. Metering base 12 is configured to be attached to the engine by suitable fasteners (not shown) inserted through mounting bores 22*a* and 22*b*. Metering base 12 is constructed of, for example, steel, aluminum, stainless steel, or other suitable material.

Metering shaft 14 is terminated at a first end with a corresponding flange 24 and at a second end with plunger-shaped poppet 26. Bearing 28 is disposed concentrically within shaft orifice 20 in metering base 12. In a default position, poppet 26 is disposed within metering port 18 and in sealing engagement therewith. Metering shaft 14 extends from poppet 26, through metering port 18, through metering chamber 16, through bearing 28, and extends a predetermined distance above top surface 30 of metering base 12. Metering shaft 14 is configured for being reciprocated in an axial direction into and out of sealing engagement with metering port 18.

Gas arrester 32 is a substantially cylindrical body disposed in abutting engagement with a bottom surface (not referenced) of flange 24 of metering shaft 14, above bearing 28. Gas arrester 32 includes a side wall 34 interconnected with a collar 36. Side wall 34 and collar 36 extend radially outward beyond a periphery of flange 24, and radially outward beyond the interface of bearing 28 with metering shaft 14.

Spring 38 is compressed between and engages bearing 28 and gas arrester 32. Spring 38 exerts an axially-directed force on each of bearing 28 and gas arrester 32, thereby seating bearing 28 on top surface 30 of metering base 12 and retaining gas arrester 32 seated against the bottom surface of flange 24. Spring 38 is selected to have a compression force which retains gas arrester 32 in position against flange 24 and retains bearing 28 against top surface 30 of metering base 12, and yet enables reciprocation of metering shaft 14.

Figure 2:
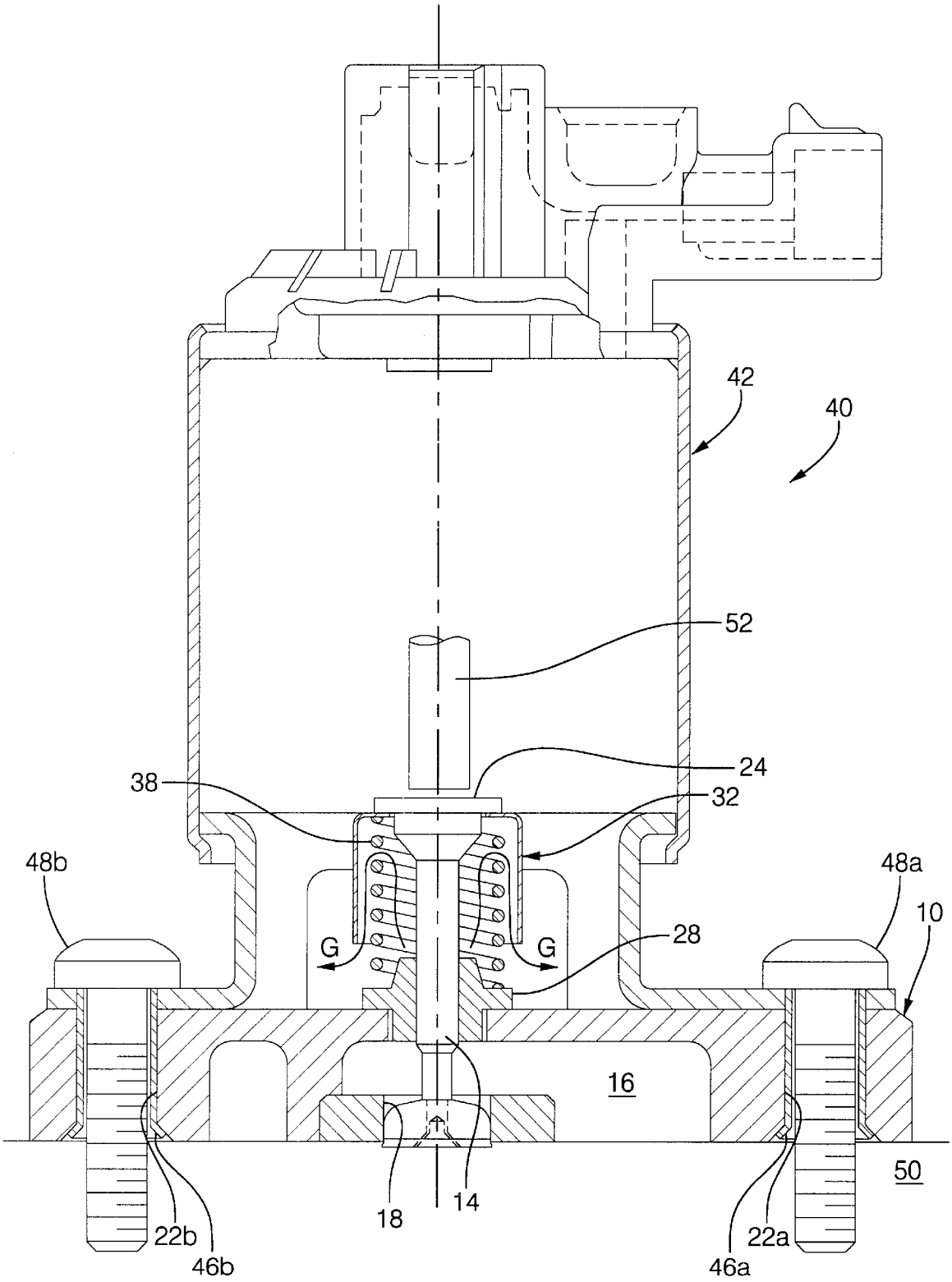
FIG. 2 is a partially sectioned view of the metering subassembly of FIG. 1 coupled to an actuator subassembly.

In use, as best shown in FIG. 2, EGR valve 40 is assembled by coupling metering subassembly 10 to actuator subassembly 42, and aligning metering mounting bores 22*a*, 22*b* with corresponding actuator mounting bores 44*a*, 44*b*. Eyelets 46*a*, 46*b* are used to preassemble actuator subassembly 42 to metering subassembly 10. Bolts 48*a*, 48*b* are inserted through mounting bore 22*a* and 44*a*, and 22*b* and 44*b*, respectively. Bolts 48*a* and 48*b* extend through mounting bores 22*a* and 22*b* and into corresponding mounting bores (not shown) in engine 50, thereby securely attaching both metering subassembly 10 and actuator subassembly 42 to each other and to engine 50.

Metering shaft 14 is terminated by flange 24 which is disposed a predetermined distance above top surface 30 of metering base 12. Actuator subassembly 42 reciprocates actuator shaft 52 which, in turn, engages flange 24 of metering shaft 14 to thereby reciprocate metering shaft 14. Flange 24 of metering shaft 14 has a relatively large surface area, and thus actuator shaft 52 need only be in general axial alignment with metering shaft 14 in order for actuator shaft 52 to engage flange 24, and thereby reciprocate metering shaft 14. The large surface area of flange 24 minimizes the effect of any axial misalignment or lack of concentricity between actuator shaft 52 and metering shaft 14. Moreover, the large surface area of flange 24 minimizes the effect of actuator shaft 52 being less than substantially parallel relative to metering shaft 14. Thus, the sensitivity of metering subassembly 10, and of EGR valve 40, to manufacturing tolerances and/or variations in actuator subassembly 42 is substantially reduced.

As stated above, metering shaft 14 is a separate shaft which does not extend contiguously into actuator subassembly 42. The configuration of metering shaft 14 as a separate shaft enables the concentricity of metering shaft 14 relative to shaft orifice 20 and relative to metering port 18 to be controlled independently of actuator subassembly 42. Thus, sources of friction found in conventional EGR valves, such as, for example, friction resulting from a non-concentricity or misalignment between the contiguous actuator shaft and one or more of the actuator orifice, the orifice in the metering body, and/or the metering port, are substantially eliminated by configuring metering shaft 14 as a separate shaft. By substantially eliminating the above-mentioned sources of friction, actuator subassembly 42 does not have to be designed, i.e., oversized, to overcome those frictional forces. Therefore, actuator subassembly 42 is smaller, lighter and lower powered than the actuators typically employed in conventional EGR valves.

Gas arrestor 32 substantially reduces penetration of exhaust gas into actuator assembly 42. Gas arrestor 32 surrounds a portion of metering shaft 14 between flange 24 of metering shaft 14 and extends downward toward top surface 30 of metering subassembly 10. Gas arrestor 32 extends radially outside of flange 24 and radially outside of bearing 28. Any exhaust gas which, by convection or through the impetus of exhaust or back pressure, escapes through the interface of bearing 28 and metering shaft 14 or through the interface of bearing 28 and shaft orifice 20, is deflected away from the interface of actuator shaft 52 with actuator subassembly 42 by gas arrester 32. More particularly, the exhaust gas rises until it contacts collar 36 of gas arrester 32, and is directed downward and away from actuator subassembly 42. As best shown in FIG. 2, side wall 34 guides the gas flows downward and away from the actuator in the general direction of arrow G.

While this invention has been described as having a preferred design, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed:

1. An engine, comprising:

modular EGR valve, said modular EGR valve comprising:

an actuator subassembly;

a metering subassembly having an elongate metering shaft, a flanged end of said metering shaft being disposed a predetermined distance above a top surface of said metering subassembly, said metering subassembly being coupled to said actuator subassembly such that said flanged end of said metering shaft is disposed proximate said actuator subassembly; and a gas arrestor having a side wall interconnected with a collar, said collar surrounding a periphery of said flanged end, said side wall extending from said collar in a direction generally toward said top surface of said metering subassembly.

2. A gas arrestor for use with a metering subassembly of a modular EGR valve, comprising:

a side wall interconnected with a collar, said side wall and said collar configured for surrounding a metering shaft of the metering subassembly, said collar configured for being disposed adjacent a periphery of a flanged end of the metering shaft, said side wall extending from said collar in a direction generally toward a top surface of the metering subassembly, wherein said sidewall has an upper end and a lower end, the distance between the lower end of the sidewall and the top surface of the metering subassembly is less than the distance between the upper end of the sidewall and the lower end of the sidewall.

3. A gas arrestor for use with a metering subassembly of a modular EGR valve, comprising:

a side wall interconnected with a collar, said side wall and said collar configured for surrounding a metering shaft of the metering subassembly, said collar configured for being disposed adjacent a periphery of a flanged end of the metering shaft, said side wall extending from said collar in a direction generally toward a top surface of the metering subassembly, said collar configured for abuttingly engaging a periphery of the flanged end of the metering shaft; and a spring configured for biasing said collar into abutting engagement with the flanged end of the metering shaft, said spring exerting an axially directed force on a bearing, retaining said bearing on a top surface of the metering subassembly.

4. A metering subassembly for use with a modular EGR valve, comprising:

an elongate metering shaft having a flanged end, said flanged end being disposed a predetermined distance above a top surface of said metering subassembly, said metering subassembly defining a metering port and a metering chamber, said metering subassembly configured for being coupled to an actuator subassembly such that said flanged end of said metering shaft is disposed proximate the actuator subassembly; and a gas arrestor having a side wall interconnected with a collar, said collar surrounding a periphery of said flanged end, said side wall extending from said collar in a direction generally toward said top surface of said metering subassembly, said sidewall having an upper end and a lower end, the distance between the lower end of the sidewall and the top surface of the metering subassembly being less than the distance between the upper end of the sidewall and the lower end of the sidewall.

5. A method of reducing penetration of exhaust gas into an actuator of a modular EGR valve, said modular EGR valve having a metering subassembly coupled to an actuator subassembly, said method comprising the steps of:

surrounding a portion of a metering shaft of the metering subassembly with a gas arrestor; and redirecting the exhaust gas away from the actuator subassembly with said gas arrestor.

6. The method of claim 5, wherein said surrounding step comprises the steps of:

biasing a collar of said gas arrestor into abutting engagement with a flanged end of the metering shaft; and surrounding at least a portion of the metering shaft with a sidewall of said gas arrestor, said sidewall of said gas arrestor extending a predetermined distance from the metering shaft.

7. A modular EGR valve, comprising:

an actuator subassembly;

a metering subassembly defining a metering port and a metering chamber, said metering subassembly having an elongate metering shaft, a flanged end of said metering shaft being disposed a predetermined distance above a top surface of said metering subassembly, said metering subassembly being coupled to said actuator subassembly such that said flanged end of said metering shaft is disposed proximate said actuator subassembly; and a gas arrestor having a side wall interconnected with a collar, said collar surrounding a periphery of said flanged end, said side wall extending from said collar in a direction generally toward said top surface of said metering subassembly.

8. The metering subassembly of claim 7, further comprising a spring, said spring biasing said collar into abutting engagement with said flanged end of said metering shaft.

9. A gas arrestor for use with a metering subassembly of a modular EGR valve, comprising:

a side wall interconnected with a collar, said side wall and said collar configured for surrounding a metering shaft of the metering subassembly, said collar configured for being disposed adjacent a periphery of a flanged end of the metering shaft.

10. The gas arrestor of claim 1, wherein said side wall extends from said collar in a direction generally toward a top surface of the metering subassembly.

11. The gas arrestor of claim 1, wherein said collar is configured for abuttingly engaging a periphery of the flanged end of the metering shaft.

12. The gas arrestor of claim 11, further comprising a spring, said spring configured for biasing said collar into abutting engagement with the flanged end of the metering shaft.

13. A metering subassembly for use with a modular EGR valve, comprising:

an elongate metering shaft having a flanged end, said flanged end being disposed a predetermined distance above a top surface of said metering subassembly, said metering subassembly defining a metering port and a metering chamber, said metering subassembly configured for being coupled to an actuator subassembly such that said flanged end of said metering shaft is disposed proximate the actuator subassembly; and a gas arrestor having a side wall interconnected with a collar, said collar surrounding a periphery of said flanged end, said side wall extending from said collar in a direction generally toward said top surface of said metering subassembly.

14. The metering subassembly of claim 13, wherein said side wall is substantially cylindrical.

15. The metering subassembly of claim 13 wherein said gas arrestor is integral with said metering shaft.

16. The metering subassembly of claim 13, wherein said collar abuttingly engages said flanged end of said metering shaft.

17. The metering subassembly of claim 16, further comprising a spring, said spring biasing said collar into abutting engagement with said flanged end of said metering shaft.

* * * * *